United States Patent [19]

Vercillo et al.

[11] Patent Number: 4,902,183

[45] Date of Patent: Feb. 20, 1990

[54] METHOD AND APPARATUS FOR BINDING MATERIALS WITH A CURLED-FINGER RING-TYPE BINDER

[75] Inventors: Alfredo J. Vercillo, Harwood Heights; Thomas T. Battisti, Buffalo Grove, both of Ill.

[73] Assignee: General Binding Corporation, Northbrook, Ill.

[21] Appl. No.: 346,918

[22] Filed: May 3, 1989

[51] Int. Cl.[4] ..... B42B 5/08

[52] U.S. Cl. ..... 412/7; 281/21.1; 281/27.1; 281/28; 412/33; 412/34; 412/38

[58] Field of Search ..... 412/7, 33, 34, 38, 39, 412/40; 281/15.1, 21.1, 27.1, 27.2, 27.3, 28

[56] References Cited

U.S. PATENT DOCUMENTS

| | | | |
|---|---|---|---|
| 1,970,285 | 10/1934 | Douvry | 281/27.1 |
| 2,234,045 | 3/1941 | Emmer | 412/40 |
| 3,433,688 | 3/1969 | Staats et al. | 412/7 |
| 3,793,660 | 2/1974 | Sims | 412/40 |
| 4,645,399 | 2/1987 | Scharer | 83/622 |

*Primary Examiner*—Douglas D. Watts
*Assistant Examiner*—Tom Hamill, Jr.
*Attorney, Agent, or Firm*—Hill, Van Santen, Steadman & Simpson

[57] ABSTRACT

An apparatus and cartridge for use in binding pre-punched sheets into a booklet using curled-finger ring-type edge binders. The binders include an opening tool which is drawn through the binder for spreading curled binder finger from the binder spine to form a document receiving gap. Binder/tool combinations are carried in the cartridge which includes a binding position or slot. The cartridge is to be positioned in an apparatus having a recessed base for receiving the cartridge and a cover which includes a paper receiving slot. The base defines a slot for alignment with the cartridge binding position slot. In the opened position, the terminus of the cover slot is aligned with the base slot. When the cartridge is in position and the cover opened, a booklet can be formed at the binding position by a binder being opened, apertured paper deposited in the cover slot and binder, and removal of the opening tool to permit the binder to close on the apertured paper.

In an alternative embodiment, various binder guiding elements, such as a well, upstanding ribs, and a ledge are defined by the base itself so as to eliminate the use of the cartridge.

23 Claims, 5 Drawing Sheets

16
94
96
98
100
102
104
106
76
74
16'e
50
16'a
92
78
80
82
90
88
86
84
54
56
58
60
64
67
62
68
66
70
52

FIG. 7
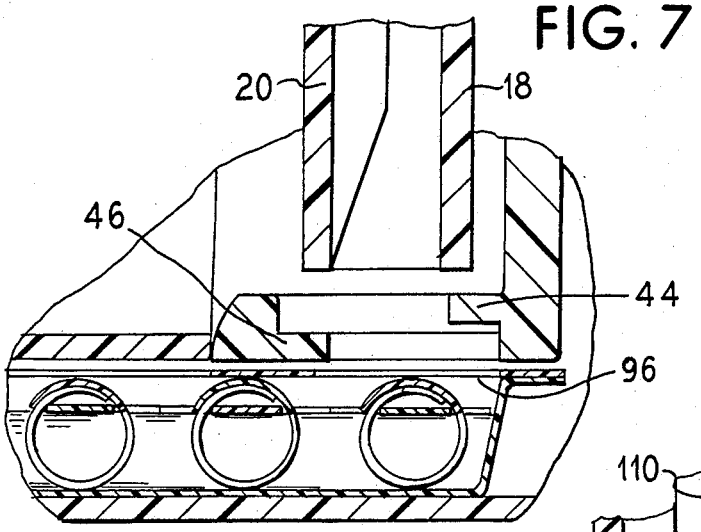
FIG. 8
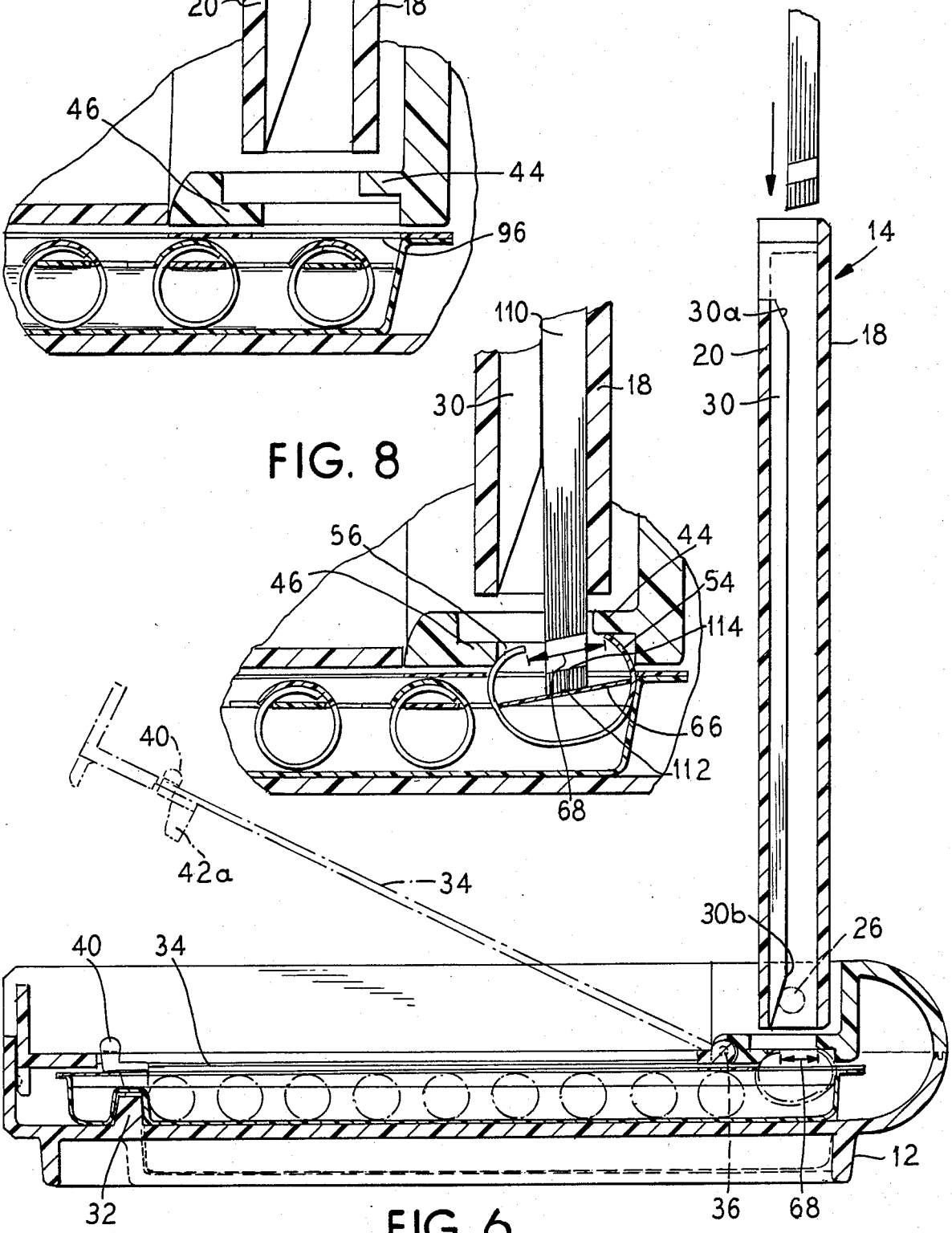
FIG. 6

METHOD AND APPARATUS FOR BINDING MATERIALS WITH A CURLED-FINGER RING-TYPE BINDER

BACKGROUND OF THE INVENTION

This invention relates to a method and apparatus for binding punched materials with a curled-finger ring-type edge binder, and more specifically, this invention relates to an apparatus for the delivery of such binders to a binding position, opening said binder, positioning prepunched materials therein and closing said binder so as to bind the punched materials together.

Curled-finger ring-type edge binders are known in the art, are generally formed of plastic and include a spine having a plurality of curled fingers spaced and positioned along the spine. At one end, the fingers are integral with one edge of the spine and are free at the other end so as to resiliently rest against the other edge of the spine. When closed these fingers extend through punched apertures in paper or the like so as to form a bound book. See, for example, U.S. Pat. No. 1,970,285.

Devices are known for opening the fingers (i.e., separating the free end of the fingers from the spine) for binding or editing of the booklet. In one apparatus, a machine is provided which includes a comb for receiving the binder where the comb includes a plurality of spaced tines between which the spaced binder fingers extend. The comb is constructed so that the spine rests against the upstanding tines of the comb with the fingers extending therebetween. Integral with the machine are grasping fingers which can be extended to a position between the curled fingers, axially shifted to engage the curled fingers and then be retracted so as to open or uncurl the fingers relative to the spine. Prepunched materials are then fitted onto the fingers and the mechanism is then operated in the reverse direction so as to permit the binder fingers to recurl and to release the binder fingers so as to close the booklet. See, for example, U.S. Pat. Nos. 3,122,761; 3,125,887; 3,227,023; 3,793,660; and 4,645,399.

These machines tend to be heavy duty and are usually intended for fixed-position office use. Furthermore, they are expensive and not easily portable. Moreover, there are times when binding jobs are to be done in the home or away from office where such a machine is not suitable.

The art has also disclosed the use of a rigid elongated member having a tapered forward end for insertion into a binder so as to spread the binding fingers and the spine of an already assembled book so as to permit editing, as opposed to binding, of the book by removal of sheets or insertion of other sheets. See, for example, German Patent No. 2 362 440 and Offenlegungschrift No. 830 636.

It is an object of this invention to provide a binding machine which is inexpensive to construct and which is suited for use in settings other than an office.

It is also desirable to provide a machine or apparatus which is useful in binding materials together and not primarily for use in editing.

It is another object of this invention to provide a simplified low cost technique and machine for opening and closing the binder.

Binders are available in numerous sizes and colors for use in different binding situations.

It is a further object of this invention to provide a binder system, as set out above, which can employ different size and color binders.

These and other objects of this invention shall become apparent from the following description and appended claims.

SUMMARY OF THE INVENTION

There is provided herein a binding system which includes a replaceable cartridge for carrying a plurality of binders and the tools for opening the binder to form a booklet. There is also provided a binding apparatus or machine which includes a recessed base for receiving the cartridge and a cover for receiving, aligning and delivering prepunched or apertured materials to an opened binder at a binding position. The binding tool is used to open the binder at a binding position and to close the binder on prepunched materials, thus binding them together.

Briefly, a cartridge of binders and tools is fitted into the recess in the machine base for delivering a binder/-binding tool combination to a binding position. The binding tool is manipulated so as to open the binder to receive prepunched material. In this situation, the free end of the curled fingers are separated from the spine so as to define a prepunched material receiving opening or gap.

Prepunched and aligned materials are delivered to the opened binder via the machine cover and engage the binding tool in the opened binder for further alignment. The binding tool is then removed from the binder so that the curled fingers of the binder resiliently snap through apertures in the prepunched material to be bound so as to permit completion of binding and formation of a bound booklet. The bound booklet is then withdrawn from the binding machine.

BRIEF DESCRIPTION OF THE DRAWINGS

FIG. 6 is a sectional view generally along line VI—VI of FIG. 2 showing the cartridge in position in the binding apparatus;

FIG. 7 is an enlarged sectional and fragmentary view of the binding apparatus at the binding position with a binder closed;

FIG. 8 is an enlarged fragmentary view similar to FIG. 7 but showing a binder opened and material to be bound positioned therein;

DESCRIPTION OF THE PREFERRED EMBODIMENT

General

Figure 1:
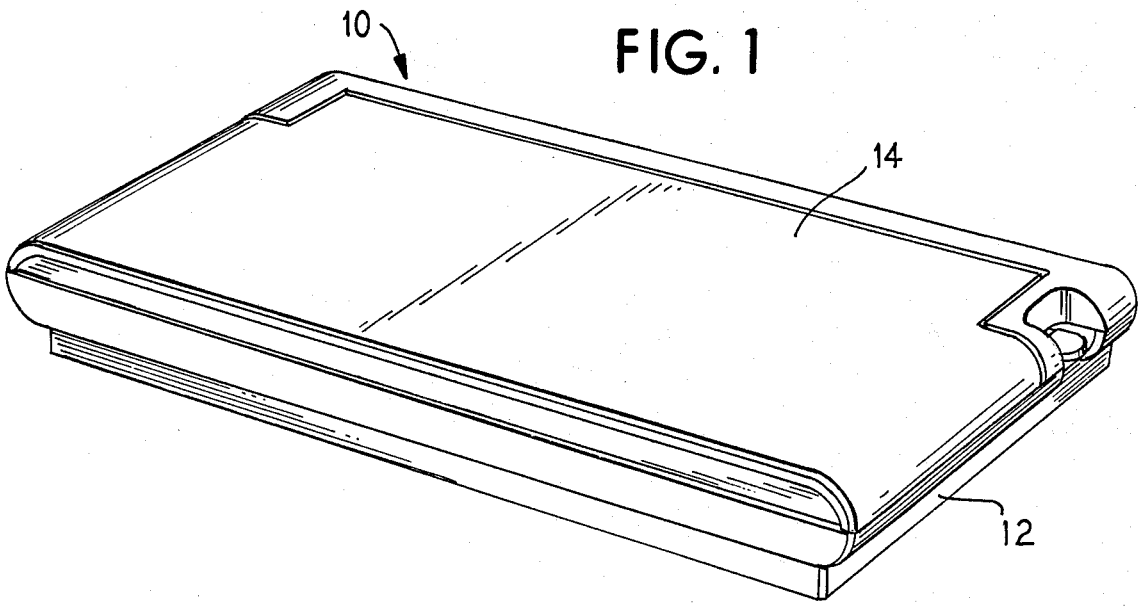
FIG. 1 is a perspective view showing a closed binding apparatus according to the invention.
Figure 2:
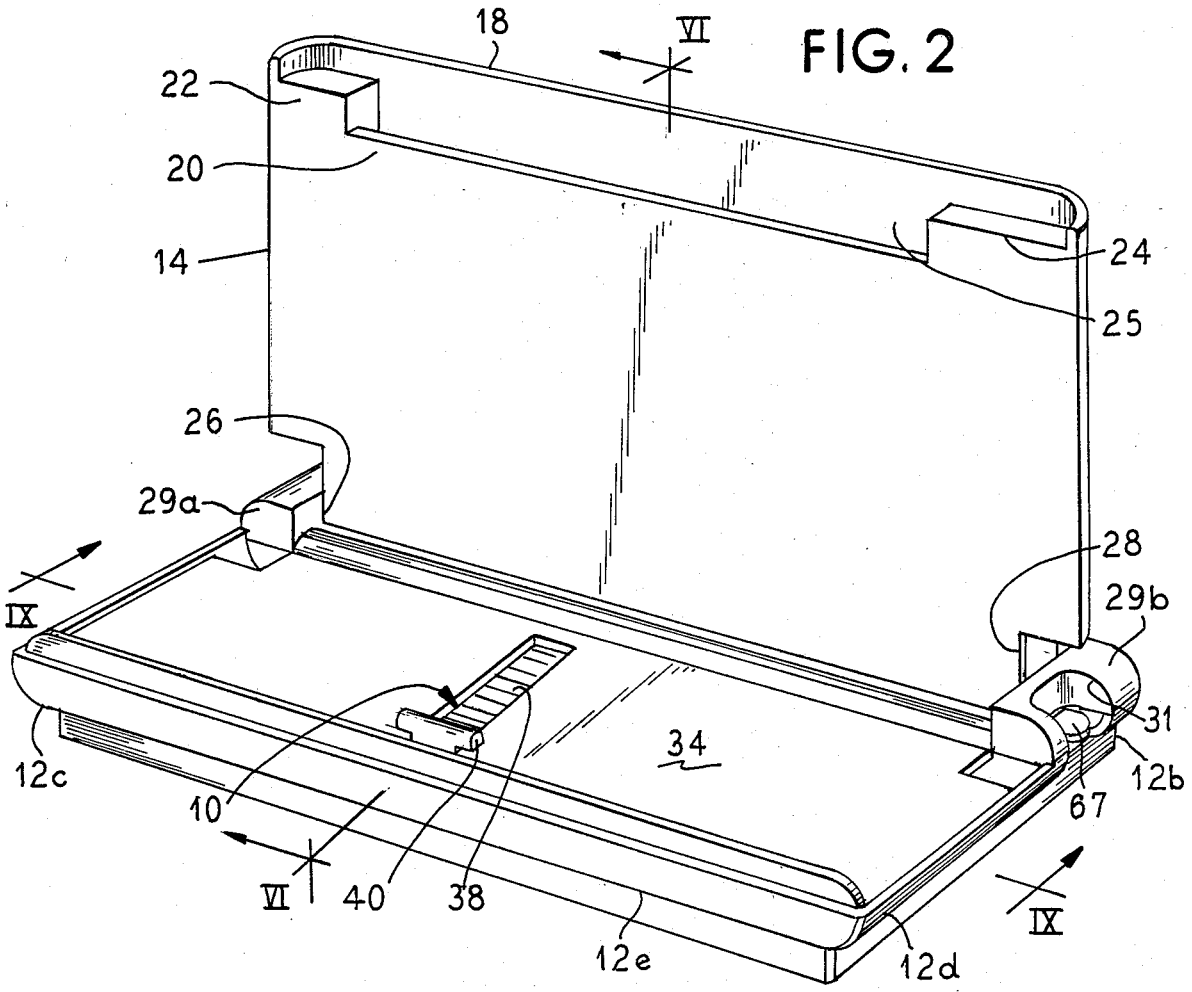
FIG. 2 is a perspective view showing the opened binding apparatus with the base and cover.
Figures 3, 4, 5:
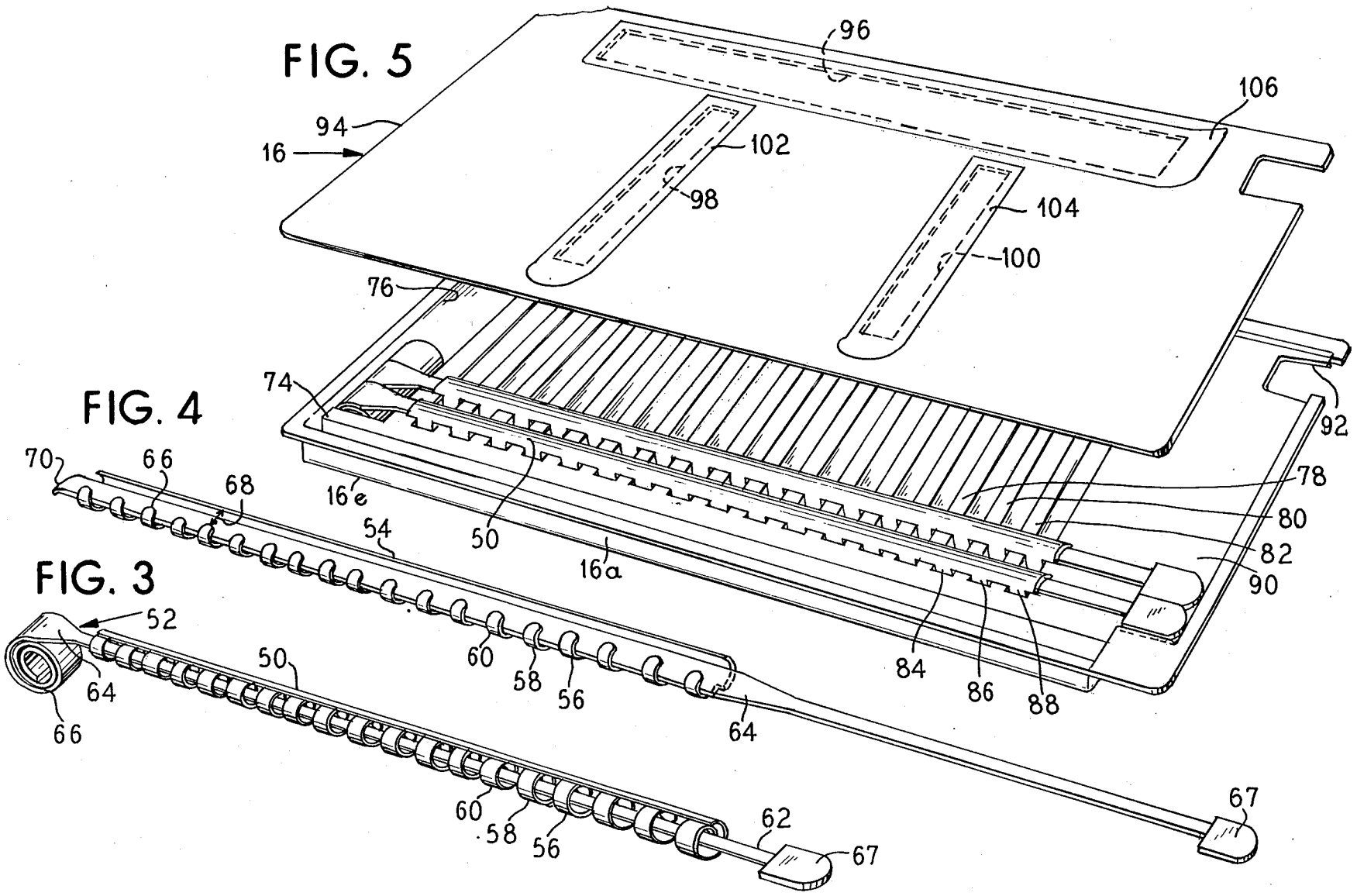
FIG. 3 is a perspective view showing a closed binder with a binding tool in a retracted position.
FIG. 4 is a perspective view, similar to FIG. 3, showing a binder in the opened position with the binding tool in an extended position.
FIG. 5 is an exploded perspective view of a cartridge for a plurality of binders and tools.

Referring first to FIG. 1, there is shown a binding apparatus 10 generally which includes a recessed base 12 and a cover 14 hingedly connected to the base 12. The base is recessed so as to receive a binder and tool carrying cartridge 16 (which is best seen in FIG. 5). In general, a binder/tool combination in the cartridge 16 is delivered to a binding position adjacent the cover 14 and the back end of the base 12. Prepunched materials to be bound are deposited, through a slot or passage formed in the cover, for alignment with the binder at the binding position and application of a binder. At that point the binder is secured to the prepunched material so as to form a bound booklet. Then the booklet is removed from the apparatus.

The Machine

Referring first to the binding apparatus 10 generally, the cover 14 includes an outer wall 18 and a spaced inner wall 20. A pair of side spacing and alignment shoulders 22 and 24 are provided for cooperation in defining a slot or passage 25 between the outer wall 18 and inner wall 20 and between the shoulders 22 and 24. This assures alignment of any materials deposited in the slot with a binding position. The cover 14 is hingedly connected to the base, at the cover's bottom and the base's back end, by hinge connections such as at 26 and 28.

The base 12 includes upstanding rear shoulders **29*a* and 29*b*, which are integral with the side edges of the base at the back and provide connections for the cover hinges, such as 26. In addition, the right-hand shoulder formation 29*b* defines a thumb-receiving notch 31** at which a tool operating pull tab can be positioned and for opening and closing a binder.

Referring to FIG. 6, the inner surface of the inner wall 20 of the cover 14 includes a plurality of alignment ribs, such as 30, which define the maximum thickness of paper that can be carried between the outer wall 18 and the inner wall 20. It is to be noted that each rib is provided with a taper **30*a* at the top end and a taper 30*b* at the bottom end. As described hereinafter, the alignment ribs 30** are positioned in the slot in alignment with spaces between binder fingers. This permits paper to be controllably deposited in the slot and bound booklets to be removed from the machine through the cover.

The base 12 includes front, back, side and bottom walls, **12*a*, 12*b*, 12*c*, 12*d* and 12*e*, which define the recess and a cartridge positioning rib 32 adjacent the front end of the base and extending between the sides thereof. The apparatus also includes a cartridge cover plate 34 which is hingedly connected to the base as at point 36, which is forward of a binding position at the back end of the base. The cover plate includes an elongated back-to-front-extending slot, such as 38, within which a pusher or slide member 40 is movable. The pusher or slide includes a plurality of depending fingers, such as 42**, which are constructed to engage a binder/tool combination and push the same toward the binding position at the back of the base.

The base defines a side-to-side binding position at the base back end between shoulders **29*a* and 29*b*. The binding position is defined by the forwardly extending shoulder 44 and the rearwardly extending shoulder 46. These shoulders are spaced from one another so as to define an elongated slot or opening extending along the back edge of the base and the opening defined by these shoulders is generally identified as the binding position. It is to be noted that the shoulders are vertically offset or staggered from one another with the back shoulder further from the base bottom wall than the front shoulder. Moreover, the exit or terminus of the cover wall ends 18 and 20** is constructed to be aligned with the binding position so that sheets of material can be dropped through the cover and into alignment with the binding position.

The Binder Element and Tool

Referring now to FIGS. 3, 4 and 5, a binder element 50 generally is shown with the opening tool 52 generally. The binder is made of plastic and includes an elongated spine 54 and a plurality of spaced, curled fingers, such as 56, 58 and 60, which are integral with one edge of the spine at one end and have a free end which resiliently engages the other edge of the spine so as to form a curved binding finger or ring.

The binding tool is an elongated member which includes a leading section 62 that is slightly longer than the binder but narrower than the binder diameter. A tapered intermediate section 64 is provided as is the trailing section 66. The trailing section 66 is shown in a curled configuration joined to the intermediate section. The trailing section is wider than the binder, and when stretched, is longer than the spine. The leading end of the tool is positioned within the binder and is provided with an operating or pull tab 67 for cooperation in positioning the binder and tool in a cartridge and for movement thereof. The back end 70 of the trailing section 65 is cut square or transverse to the length of the tool.

As shown in FIG. 4, the tab 67 can be pulled which causes the leading section to be pulled from the binder, the intermediate section to engage the fingers and spine, and the trailing section 66 to hold the spine and fingers in an opened position so as to define a gap 68 between the spine 54 and the free end of fingers such as 56, 58 and 60. The tool is longitudinally flexible, but laterally stiff. It has been found that the tool, when it is maintained in a horizontal position, causes the spine and fingers to separate and the binder to rotate so that the gap 68 is in the upwardly open position. The end 70 of the trailing section is cut transverse of the length of the tool so that as the tool is withdrawn from the binder and past the end of a finger, the finger will resiliently snap to the closed or curled position.

The Cartridge

The cartridge 16 is constructed to carry a plurality of binder/tool combinations. For convenience, there can be a number of different cartridges for different color binders or different sizes.

Referring now to FIG. 5, the cartridge 16 includes a front wall **16*a*, a back wall 16*b*, side walls 16*c* and 16*d* and a bottom wall 16*e*. The walls define a bottom 72 which is shaped to provide a guide recess 74 for engaging the guide rib 32 so as to orient the cartridge relative to the binding apparatus. The cartridge bottom includes a well or large opening 76 on one side, such as 16*c*, which extends from the front to the back of the cartridge and receives the coiled trailing section of the opening tool. The cartridge also includes a plurality of binder spine-engaging ribs, such as 78, 80 and 82, which extend between the front and back walls, and form therebetween a plurality of binder finger-receiving channels such as 84, 86 and 88. The cartridge bottom includes an elongated flat surface or ledge, such as 90, on the other side, such as 16***d*, on which the opening portion of the tool or tab 67 rests for spacing the tools from one another and for opening. The ledge or flat portion 90 of the cartridge defines a notch 92 aligned with the binding position for grasping an exposed tab, such as 67, and pulling the tool through the binder so as to open and/or close the binder when in the binding position. This notch 92 is constructed to be aligned with the apparatus notch 31.

It is noted that in this construction, the curled binder fingers extend into the channels or recesses, such as 84, 86 and 88, and the spine, such as 50, rests on the top surface of the ribs. A cartridge cover 94 is provided for covering most of the base of the cartridge. The cover closes the top of the cartridge, is adhered to the peripheral edges of the cartridge, and is spaced from the ledge 90 and binders so as to permit movement of the binders within the cartridge.

The cover also defines a side-to-side oriented binding position or slot 96 at the back end of the cover and a pair of front-to-back oriented pusher receiving slots 98 and 100, which extend from the front edge of the cartridge toward the binding slot. The pusher slots 98 and 100 are intended for cooperation with the cover plate 34 and pusher fingers, such as 42*a* or 42*b*, so as to permit the pusher to engage the binders and to push a binder/-tool to the binding position slot 96.

For convenience, the slots may be covered with releasable adhesive tape-type members, such as 102, 104 and 106. In use such members can either be separate or a single adhesive sheet extending across the entire top surface. Use of the adhesive members or sheet to close the slot permits ready transportation of the separate cartridges and prevents loss thereof during shipment and prior to use.

The Cartridge and the Apparatus

Figure 10:
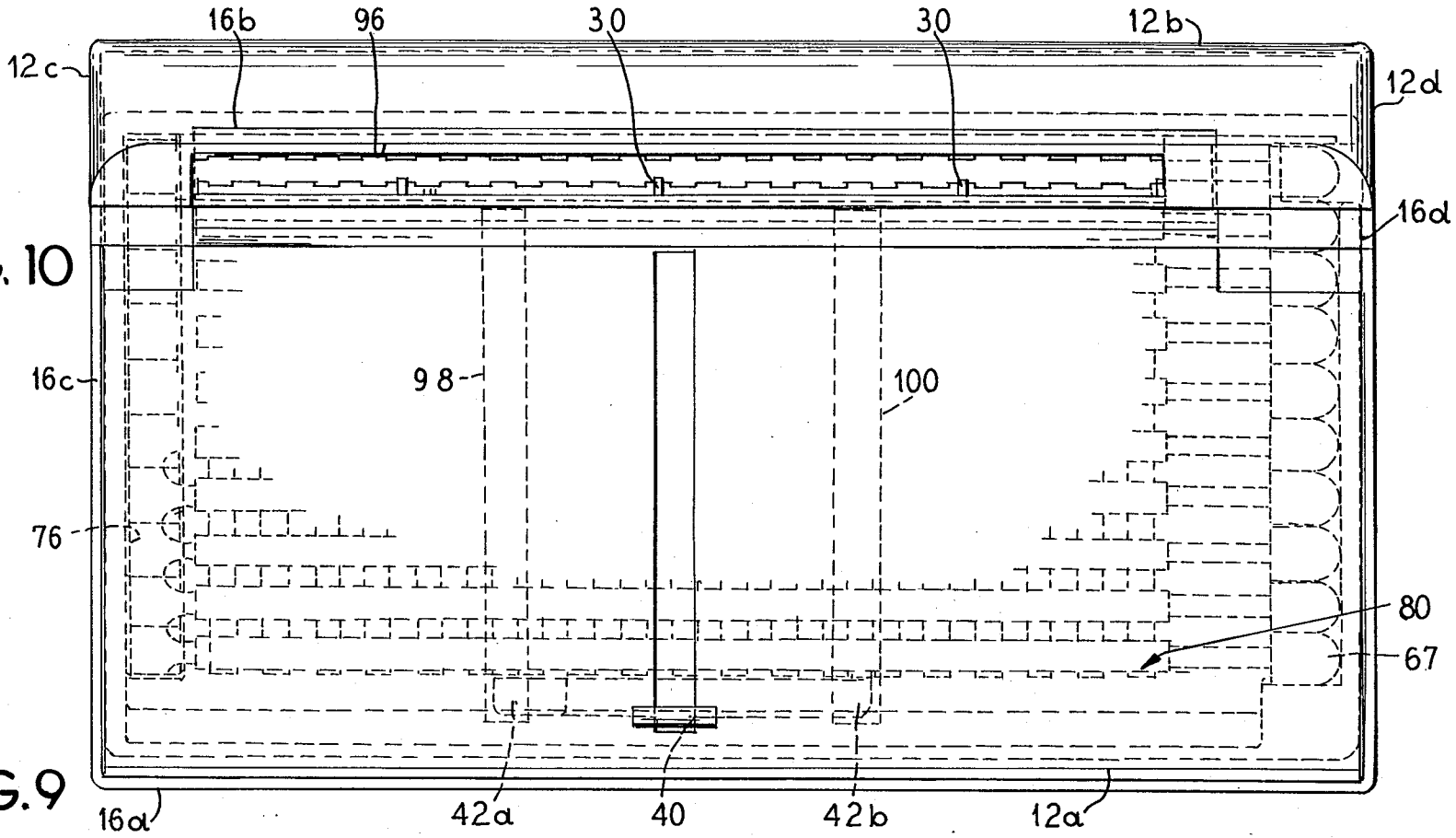
FIG. 10 is a plan view showing a cartridge in position in the base of a binding apparatus.
Figure 9:
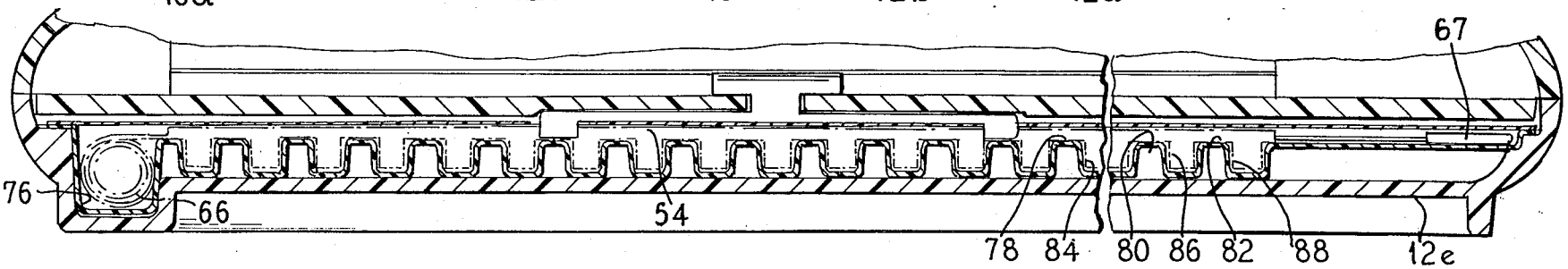
FIG. 9 is a vertical sectional view along line IX—IX of FIG. 2 showing the cartridge positioned in the base of the binding apparatus.

It is noted from FIGS. 9 and 10 that the pusher element 40 and wings or legs, such as 42*a* and 42*b*, orient and push the binder elements. FIG. 9 shows the cartridge positioned in a base. There the cross-section of the rib-like members 78, 80 and 82 and the finger-receiving channels or depressions 84, 86 and 88 are seen. Also seen is the manner in which a binder, such as 50, and a tool 52 fit within the cartridge. As seen in FIG. 9, the binder fits in the cartridge with the fingers depending downwardly into the channel or depression between ribs, such as 78, 80 and 82, and the spine 54 rests on the top edge of the ribs. The coiled end of the tool 66 is disposed in the well 76, the tool's leading section 64 extends through the binder, and the tabs, such as 67, rest on the ledge 90 of the cartridge 90.

Referring now to FIG. 10, a plan view of the cartridge in the base is shown. There it is seen that the pusher 40 includes the fingers 42*a* and 42*b* for engaging binder. The fingers 42*a* and 42*b* extend through the slots 98 and 100 in the cartridge. The binding position slot 96 is shown with the binder in position to be opened and to bind paper inserted therein. It is noted that the slot is carefully dimensioned so as to have a width and length similar to the profile of the binder. In addition, the guide ribs, such as 30 in the cover member, are shown for use in guiding the paper into the binding position.

Referring back to FIG. 7, it is seen that the binding position is further identified by the slot 96, as shown therein, and the slot 96 is generally aligned with the opening defined by the cover members 18 and 20 and by the shoulders 44 and 46.

Operation

This system can be used by first opening the cover section 14 so as to expose the internal portion of the apparatus.

The puncher cover 34 is raised so that the machine is prepared to receive the cartridge. An appropriate cartridge is selected and the adhesive members 102, 104 and 106 are removed so as to expose the pusher slots 98 and 100 and the binding slot 96. Once the adhesive members are removed, the cartridge is positioned in the machine, and the cover 34 is closed so that the pusher 40 engages the binders, such as 50, so as to push the same toward the binding position.

Referring to FIG. 7, it is shown that the binders have been pushed rearwardly in the cartridge and that a binder is positioned in the binding position below the cartridge position 96 and below the slot formed by cover shoulders 44 and 46 and end shoulders 26 and 28. In this position, a binder pull tab, such as 67, which is exposed in the right-hand rear notch 31, is pulled outwardly from the machine, which causes the intermediate tool section 64 to engage the binder spine 54 and initially curled fingers.

In this situation, the binder rotates to an open position in which the least force is required to spread the fingers and the spine. The binder spine in a sense rotates backwardly and downwardly and engages the upper or rearward shoulder 44, and the fingers engage the lower or forward shoulder 46 so as to form the gap 68. The spine can be thought of as rotating from an upper horizontal to a rearward vertical position. This is seen in FIG. 8 where the tool has opened the binder and the binder rises by the tool cooperating with the rib tops and trailing section of the binder. In this condition, the spine 54 engages the back surface of the cartridge and the underside of shoulder 44. The fingers, such as 56, open and engage the shoulder 46 and also define a gap 68 between the edge of the binder spine and free end of the finger so as to receive paper dropped therein. The paper to be bound is prepunched and dropped into the cover where it engages the back or top surface of the cover 14 and the ribs, such as 30, so as to be aligned with the binding position as it is dropped into the gap 68 of the open binder. The trailing section of the tool, such as 66, is shown forcing the binder open and holding it in the binding position.

The paper 110 has an edge 112 (which is usually a side of the booklet) which engages the tool trailing section 66 for vertical alignment. The paper has been punched so as to define binding apertures 114. The distance between the edge 112 of paper and adjacent aperture 114 is known as the back gauge distance. It is seen that the free end of the fingers, such as 68, is generally aligned with the aperture so that when the finger is released, it will snap through the aperture so as to bind the paper at that point to the binder. Thus, the back gauge distance and binding apertures are such that the apertures and the fingers are generally aligned. In addition, the lateral alignment, i.e., along the length of the binder, is assured by the lateral or side-to-side constraints on the binder and on the deposited paper.

Based upon the alignment of the finger relative to the aperture and tool and the side-to-side positioning of the paper and binder, binding through the aperture is achieved.

After the tool is first pulled and all of the fingers are held in the open position, the paper is deposited and the tool is then further withdrawn. As the tool's back edge 70 passes the fingers, it releases them and they resiliently snap and lock the binder onto the apertured paper so as to bind the same together and form a booklet. Then the tool is fully withdrawn so as to complete the binding and may be discarded.

The bound material is removed from the machine by pulling it upwardly through the cover. When a bound booklet is pulled up through the cover 14 and slot 25, as indicated previously and seen best in FIG. 10, the alignment ribs 30 inside the cover slot 25 are aligned with spaces between the binder fingers. This alignment permits the bound booklet (i.e., paper and binder) to be withdrawn upwardly through the slot. The distance between the inner wall 20 and outer wall 18 is greater than the diameter of a binder. With the foregoing dimensioning and positioning, the completed booklet can be withdrawn from the binding machine. It is then possible to remove the cartridge, which perhaps has in it black colored binders and replace it with a different colored cartridge that is desired or binding can be continued with other binders in the same cartridge.

Alternative Embodiment and Method of Operation

Figure 11:
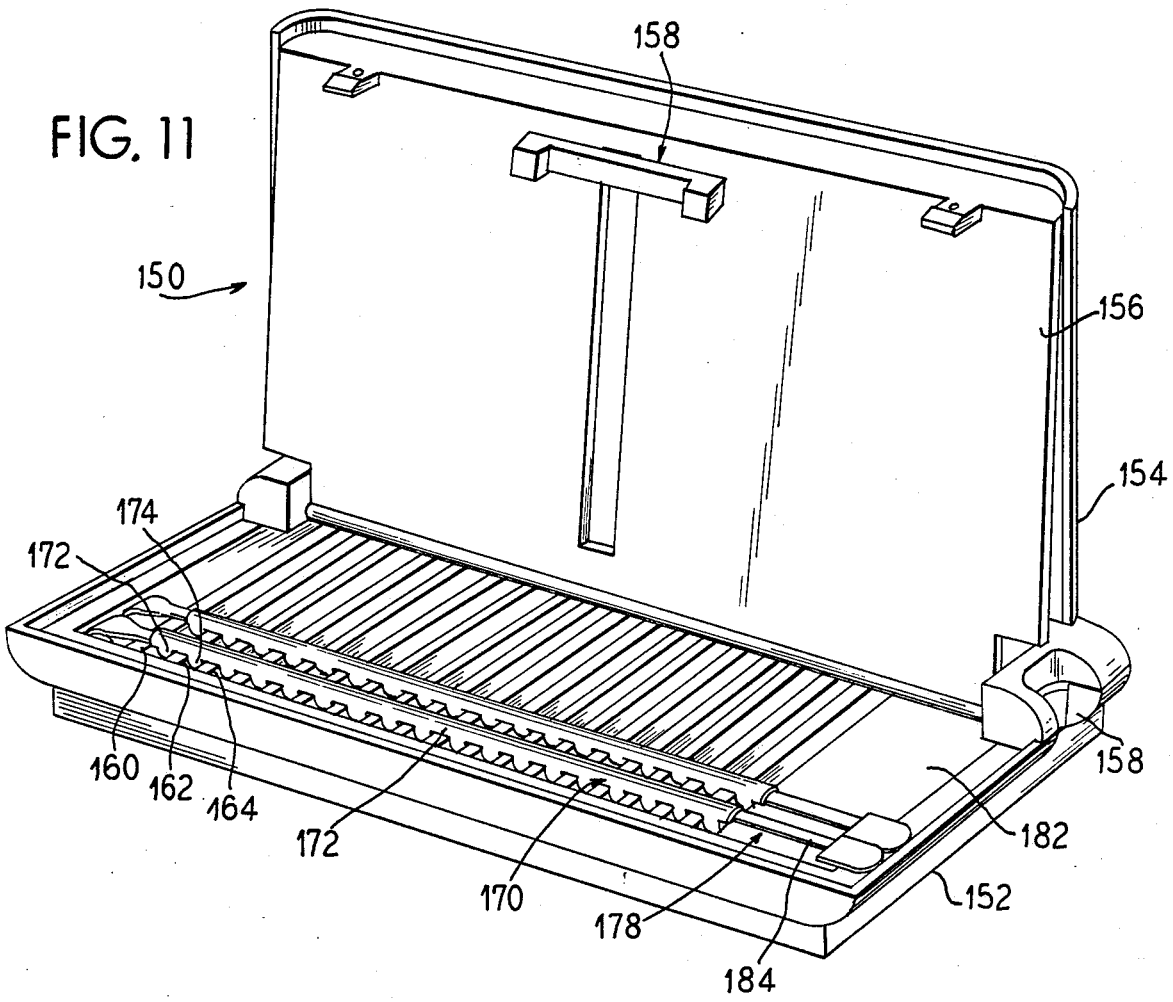
FIG. 11 is a perspective view of an opened binding machine having binder guides formed into the base.

Referring to FIG. 11, an alternative machine embodiment 150 generally is shown. This embodiment includes a base 152, outer cover 154, pusher cover 156, and notch 158 for exposing and withdrawing a binder opening tool, binding position (not shown), and most other components as shown in the principal embodiments in FIGS. 1–10 and described hereinbefore. The principal difference between the prior embodiment and this embodiment is the formation in the base of the binder divider ribs, well and ledge, which in the first embodiment was part of the insertable and removable cartridge.

The puncher cover is hingedly connected to the base and carries a pusher member 158 generally which is operated to push binders from the front of the machine to a binding position at the back.

Figure 12:
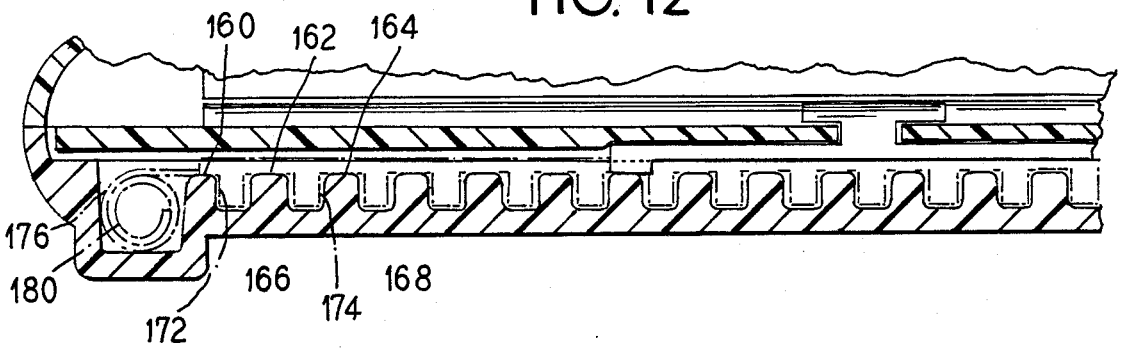
FIG. 12 is a sectional view of a base of the type shown in FIG. 11 showing the formation of the binder guides in the base.

The base includes a plurality of spaced and upstanding binder supporting ribs, such as 160, 162 and 164, that extend from the front of the machine to the binding position at the back. The ribs define channels, such as 166 and 168, therebetween for receiving binder fingers. In other words, the binder spine rests on the top of the ribs and the fingers in the channels therebetween. This is best seen in FIG. 12 with reference to binder 170, generally having a spine 172 and downwardly extending fingers such as 174 and 176. Walls in the base also form the well 176 on one side of the ribs within which the coiled trailing and 180 of a binder opening tool 178 is positioned.

A tool receiving ledge 182 is formed on the other side of the ribs and leading end 184 of a tool, such as 178, rest thereon and is supported thereby in its movement toward the back end of the machine and the binding position.

The operation of this embodiment in that the pusher cover 156 is closed, the binders are pushed rearwardly to the binding position, the binder tool is withdrawn to open the binder, apertured paper to be bound is guided thereto and the tool is fully withdrawn so as to close the binder so sheets and form a booklet.

Although the invention has been described with respect to preferred embodiments, it is not to be so limited as changes and modifications can be made which are within the full intended scope of the invention as defined by the appended claims.

We claim:

1. A cartridge for use in carrying and applying a curled-finger ring-type binder to prepunched sheets to form a booklet using an elongated tool assembled with the binder, said tool having leading, intermediate and trailing sections for opening the binder, said cartridge including:

a housing for carrying at least one binder/tool combination;

a binding slot defined by the housing adjacent a wall of the housing and constructed for use in applying the binder to prepunched paper and to permit the binder to exit the housing therefrom; and means for moving a binder/tool combination within the housing to the slot.

2. A cartridge as in claim 1, wherein said cartridge includes a base section and a cover section wherein said base section includes front, back, side and bottom walls which define:

a binder/tool receiving recess and a plurality of binder guide ribs, each of which extends between the front and back walls, said ribs defining guide channels therebetween and constructed to receive thereon a binder with the binder spine resting on the ribs and fingers extending into the channels therebetween.

3. A cartridge as in claim 2, wherein said base section further defines a well section adjacent one side wall of the base and extending between the front and back walls for receiving the trailing edge of a tool.

4. A cartridge as in claim 2, wherein said base section further includes a ledge section adjacent a side wall of the base and extending between the front and back walls for receiving and supporting thereon the frontmost part of the tool leading section and for defining an operator edge adjacent the back wall for exposing the frontmost edge of a tool for cooperation in drawing the tool through the binder.

5. A cartridge as in claim 2, wherein said cover section is constructed to cover the base portion and define a binding slot at which a binder can be positioned for binding.

6. A cartridge as in claim 1, wherein said base includes orienting means for orienting the cartridge in a binding apparatus.

7. A cartridge as in claim 6, wherein said orienting means defines a channel adjacent the front wall of the cartridge and extending between the side walls thereof.

8. A cartridge as in claim 1, wherein said cover is essentially flat and each of said slot is covered by a releasable adhesive member.

9. A cartridge as in claim 3, wherein said trailing section receiving well extends parallel to the finger receiving channels.

10. An apparatus for use in forming a bound booklet by applying a curled-finger ring-type edge binder to prepunched sheets comprising:

a base for receiving a binder holding and delivering cartridge;

a cover hingedly associated with the base and defining a sheet aligning and delivering slot; and means defining a binding position cooperatively associated with one of said base or cover and at which a binder is adapted to be positioned for binding to said prepunched sheets.

11. An apparatus as in claim 10 having front, back, side and bottom walls which define a binder cartridge receiving recess, said base defining said binding position slot and having a pair of outboard and hinge defining shoulders.

12. An apparatus as in claim 10, wherein said cover has spaced inner and outer walls which define a paper receiving slot constructed to be aligned with a binding position in said base when said cover is open, and when in the closed position, said cover overlies said base recess and closes said apparatus.

13. An apparatus as in claim 10, wherein said apparatus includes a cartridge cover plate having a front-to-back slot and pusher means associated therewith for urging binders in a cartridge toward said binding position, said pusher means having a handle portion on one side of said pusher means and binder engaging finger means on the other side of said pusher means for engaging said binder.

14. An apparatus as in claim 10, wherein said base defines said binding slot and includes a pair of elongated side-to-side extending shoulders spaced from one another so as to define said slot therebetween.

15. An apparatus as in claim 14, wherein said shoulders are offset from one another.

16. An apparatus as in claim 15, wherein one shoulder is positioned closer to the base than the other shoulder.

17. An apparatus as in claim 10, wherein there is further provided a plurality of ribs associated with said cover and which are constructed to vertically extend along the inside surface of said cover when opened and which ribs are spaced apart a distance effective to permit a binder to fit therebetween with fingers of the binder on either side of the ribs.

18. An apparatus as in claim 17, wherein the width of the cover slot is greater than the diameter of the binder.

19. An apparatus for use in forming a bound booklet by applying a curled-finger ring-type edge binder to prepunched sheets comprising:

a base for receiving at least one binder/tool combination;

a cover hingedly associated with the base and defining a sheet aligning and delivering slot; and means defining a binding position cooperatively associated with one of said base or cover and at which a binder is adapted to be positioned for binding to said prepunched sheets.

20. An apparatus as in claim 19 having front, back, side and bottom walls which define binder/tool receiving elements including a plurality of upstanding ribs which define a channel therebetween, whereby a binder spine rests on said ribs and binding fingers extend into said channels therebetween.

21. An apparatus as in claim 20, wherein along one side of said base further defines an elongated well extending from the front toward the back of the base for receiving curled ends of the tool, and along the other side the base defines an elongated ledge extending from the front toward the back of the base for supporting the frontmost position of the binder opening tool.

22. A method of forming a bound booklet having a plurality of apertured sheets and a curled-finger ring-type binder joining said sheets in a booklet using a device constructed to carry at least one binder/opening tool combination, said device defining a binding position slot, wherein said method comprises the steps of:

urging a binder/tool combination in said device toward said binding position slot;

drawing the tool of binder/tool combination through the binder to spread binder fingers from said binder spine so as to form a document receiving gap;

depositing apertured sheets in said binder gap with said apertures generally aligned with the free ends of said fingers; and completely withdrawing the tool from the binder so as to permit the uncurled fingers to return to an initial closed position by passing through said apertures so as to bind said sheets together.

23. A method as in claim 22, wherein said tool is axially drawn into and withdrawn from said binder.

* * * * *